US012320042B2

(12) United States Patent
Boyette et al.

(10) Patent No.: US 12,320,042 B2
(45) **Date of Patent: *Jun. 3, 2025**

(54) FLAME-RESISTANT FABRIC

(71) Applicant: Milliken & Company, Spartanburg, SC (US)

(72) Inventors: Rachel W. Boyette, Taylors, SC (US); Andrew D. Child, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 1036 days.

This patent is subject to a terminal disclaimer.

(21) Appl. No.: 17/003,151

(22) Filed: Aug. 26, 2020

(65) Prior Publication Data

US 2021/0062375 A1 Mar. 4, 2021

Related U.S. Application Data

(60) Provisional application No. 62/895,732, filed on Sep. 4, 2019.

(51) Int. Cl.
*D03D 1/00* (2006.01)
*D03D 15/513* (2021.01)

(52) U.S. Cl.
CPC ..... *D03D 15/513* (2021.01); *D10B 2201/22* (2013.01); *D10B 2321/101* (2013.01); *D10B 2331/021* (2013.01); *D10B 2501/04* (2013.01)

(58) Field of Classification Search
CPC ..... D03D 15/12; D03D 1/0035; D01F 1/04; D01F 6/605; D03G 3/047
USPC ..... 428/219
See application file for complete search history.

(56) References Cited

U.S. PATENT DOCUMENTS

| | | | | |
|---|---|---|---|---|
| 2,828,228 | A | 3/1958 | Glade | |
| 3,640,823 | A | 2/1972 | Linderman | |
| 3,803,453 | A * | 4/1974 | Hull | D01F 8/04 264/105 |
| 4,282,283 | A | 8/1981 | George | |
| 4,533,592 | A | 8/1985 | Bingham | |
| 4,569,088 | A | 2/1986 | Frankenburg et al. | 2/81 |
| 5,149,582 | A | 9/1992 | Lamarca, II | |
| 5,279,287 | A | 1/1994 | Wiseman, Sr. | 128/201.29 |
| 5,506,043 | A | 4/1996 | Lilani | |
| 5,727,401 | A | 3/1998 | Statham | |
| 6,787,228 | B2 | 9/2004 | Campbell | |
| 6,823,548 | B2 | 11/2004 | Murphy | |
| 7,168,140 | B2 | 1/2007 | McKee et al. | 28/167 |
| 7,182,991 | B1 | 2/2007 | Hirschmann, Jr. et al. | 428/86 |
| 7,226,877 | B2 | 6/2007 | Bascom | |
| 7,247,585 | B2 | 7/2007 | Bascom | |
| 7,259,117 | B2 | 8/2007 | Mater | |
| 7,393,800 | B2 | 7/2008 | Corner | |
| 7,484,256 | B2 | 2/2009 | Murphy | |
| 7,589,036 | B2 | 9/2009 | Corner | |
| 7,589,037 | B2 | 9/2009 | Handermann | |
| 7,601,414 | B2 | 10/2009 | Handermann | |
| 8,722,145 | B2 | 5/2014 | Panse | |
| 8,732,863 | B2 | 5/2014 | Hines | |
| 8,741,789 | B2 | 6/2014 | Li et al. | 442/136 |
| 9,034,777 | B2 | 5/2015 | Hines et al. | |
| 9,370,212 | B2 | 6/2016 | Zhu | |
| 9,885,128 | B2 | 2/2018 | Cliver et al. | |
| 9,920,474 | B2 | 3/2018 | Bonner et al. | |
| 9,926,663 | B2 | 3/2018 | Valenta et al. | |
| 10,030,326 | B2 | 7/2018 | Hines, Jr. et al. | |
| 10,202,720 | B2 | 2/2019 | Cliver et al. | |
| 12,006,601 | B1 * | 6/2024 | Hines, Jr. | D03D 15/283 |
| 2001/0009832 | A1 | 7/2001 | Shaffer | |
| 2002/0142686 | A1 | 10/2002 | Lapierre | |
| 2003/0148689 | A1 | 8/2003 | Lapierre | |
| 2003/0228812 | A1 | 12/2003 | Stanhope | |
| 2003/0232560 | A1 | 12/2003 | Corner | |
| 2004/0060119 | A1 | 4/2004 | Murphy | |
| 2004/0060120 | A1 | 4/2004 | Murphy | |
| 2004/0152378 | A1 | 8/2004 | Stanhope | |
| 2004/0192134 | A1 | 9/2004 | Gibson | |
| 2005/0025963 | A1 | 2/2005 | Zhu | |
| 2005/0079783 | A1 | 4/2005 | Campbell | |
| 2005/0097877 | A1 | 5/2005 | Hainsworth | |
| 2005/0186875 | A1 | 8/2005 | Lilani | |
| 2005/0204718 | A1 | 9/2005 | Zhu | |
| 2005/0208855 | A1 | 9/2005 | Zhu | |
| 2005/0255771 | A1 | 11/2005 | Chetty | |
| 2006/0030228 | A1 | 2/2006 | Truesdale, III | |
| 2006/0040575 | A1 | 2/2006 | Kelleher | |
| 2006/0059634 | A1 | 3/2006 | Tutterow | |
| 2006/0068664 | A1 | 3/2006 | Gibson | |
| 2006/0111000 | A1 | 5/2006 | Bascom | |
| 2006/0135014 | A1 | 6/2006 | Murphy | |

(Continued)

FOREIGN PATENT DOCUMENTS

| | | |
|---|---|---|
| CA | 2814640 | 4/2012 |
| EP | 3425093 | 1/2019 |

(Continued)

OTHER PUBLICATIONS

PCT/US2020/048319 Search Report, Mail Date Jan. 18, 2021.
PCT/US2020/048319 Written Opinion.

*Primary Examiner* — Tahseen Khan
(74) *Attorney, Agent, or Firm* — Cheryl J. Brickey

(57) ABSTRACT

A flame-resistant fabric containing staple yarns which contain non-FR cellulosic fibers, modacrylic fibers, and non-flammable fibers intimately blended together. At least a portion of the non-flammable fibers comprise an energy absorbing additive to form energy absorbing fibers. The fabric comprises less than 14 wt. % of energy absorbing fibers and the fabric has an arc resistance according to ASTM F1959/F1959M-14e1 of at least 1.33 calories per square centimeter per ounce per square yard of fabric.

11 Claims, No Drawings

(56) References Cited

U.S. PATENT DOCUMENTS

| | | | | |
|---|---|---|---|---|
| 2006/0135023 | A1 | 6/2006 | Knoff | |
| 2006/0141880 | A1 | 6/2006 | Bascom | |
| 2006/0160454 | A1 | 7/2006 | Handermann | |
| 2006/0292953 | A1 | 12/2006 | Ashley | |
| 2007/0004302 | A1 | 1/2007 | McKinnon | |
| 2007/0077839 | A1 | 4/2007 | McKinnon | |
| 2007/0224900 | A1 | 9/2007 | Tucker | |
| 2007/0275617 | A1 | 11/2007 | Harris | |
| 2008/0057807 | A1 | 3/2008 | Tutterow | |
| 2008/0085651 | A1 | 4/2008 | Handermann | |
| 2008/0098503 | A1 | 5/2008 | Swartz | |
| 2008/0299854 | A1 | 12/2008 | Hilleary | |
| 2009/0111345 | A1 | 4/2009 | Panse | |
| 2009/0178186 | A1 | 7/2009 | Truesdale | |
| 2010/0112312 | A1 | 5/2010 | Tutterow et al. | 428/196 |
| 2010/0281923 | A1 | 11/2010 | Zumloh-Nebe | |
| 2010/0297905 | A1 | 11/2010 | Ulrich | |
| 2010/0298454 | A1 | 11/2010 | Chew | |
| 2010/0319850 | A1 | 12/2010 | Panse | |
| 2011/0104466 | A1 | 5/2011 | Atkinson | |
| 2011/0173734 | A1 | 7/2011 | Mikhail | |
| 2011/0183561 | A1 | 7/2011 | Panse | |
| 2011/0275267 | A1 | 11/2011 | Smith | |
| 2012/0090080 | A1 | 4/2012 | Stanhope | |
| 2012/0144794 | A1 | 6/2012 | Ke | |
| 2012/0146784 | A1 | 6/2012 | Hines | |
| 2012/0167269 | A1 | 7/2012 | Hernandez | |
| 2012/0171918 | A1 | 7/2012 | Lawson, III | |
| 2012/0183747 | A1 | 7/2012 | Bader | |
| 2012/0260422 | A1 | 10/2012 | Rock | |
| 2013/0022805 | A1 | 1/2013 | Small, Jr. | |
| 2013/0042385 | A1 | 2/2013 | Hines | |
| 2013/0055490 | A1 | 3/2013 | Zhu | |
| 2013/0064570 | A1 | 3/2013 | Yamane | |
| 2013/0065470 | A1 | 3/2013 | Rock | |
| 2013/0152262 | A1 | 6/2013 | Bedetti | |
| 2013/0212790 | A1 | 8/2013 | Waxman | |
| 2013/0247287 | A1 | 9/2013 | Mizobuchi | |
| 2014/0041107 | A1 | 2/2014 | Rose | |
| 2014/0075659 | A1 | 3/2014 | Li | |
| 2014/0113122 | A1 | 4/2014 | Smith | |
| 2014/0261852 | A1 | 9/2014 | Bonner | |
| 2017/0310032 | A1 | 10/2017 | Sasaki et al. | |
| 2018/0057964 | A1 | 3/2018 | Andersen | |
| 2018/0057978 | A1 | 3/2018 | Zhu | |
| 2018/0171516 | A1* | 6/2018 | Stanhope | A41D 31/08 |
| 2019/0106816 | A1 | 4/2019 | Beagle | |

FOREIGN PATENT DOCUMENTS

| | | |
|---|---|---|
| WO | WO 2004/005606 | 1/2004 |
| WO | 2004088023 | 10/2004 |
| WO | 2005090660 | 9/2005 |
| WO | 2006017709 | 2/2006 |
| WO | 2008027454 | 3/2008 |
| WO | 2011137213 | 11/2011 |
| WO | 2012121759 | 9/2012 |

* cited by examiner

FLAME-RESISTANT FABRIC

RELATED APPLICATIONS

This application claims priority to U.S. Provisional Patent Application 62/895,732, filed on Sep. 4, 2019, which is herein incorporated by reference in its entirety.

TECHNICAL FIELD OF THE INVENTION

ThFlameis patent application relates to flame-resistant fabrics that also provide protection from near-infrared radiation, such as that emitted by arc flashes.

BACKGROUND

An arc flash (or arc blast) is a type of electrical discharge resulting from a low impedance connection to ground or another voltage phase in an electrical system. In particular, the arc flash is produced by an electrical breakdown of the resistance of air which occurs when there is sufficient voltage in an electrical system and a path to ground or lower voltage. An arc flash typically releases a massive amount of energy that vaporizes metal conductors in the electrical system, blasting molten metal and expanding plasma outward from the source, and produces a shock wave due to the rapid heating of the gases in the vicinity. The arc flash and the metal plasma produced by the flash rapidly release tremendous amounts of electromagnetic radiation (e.g., light energy ranging from infrared to ultraviolet wavelengths), and this electromagnetic radiation rapidly heats the surfaces that it contacts. For example, the infrared radiation generated during an arc flash can cause severe burns to the unprotected or underprotected skin of individuals in the vicinity of the arc flash.

In view of the dangers posed by arc flashes, protective clothing has been developed to protect workers at risk of exposure to arc flashes, such as electrical workers and electricians. Such arc resistant clothing systems are designed to provide varying degrees of protection to the wearer, with the requisite or recommended level of protection being determined by the severity of the arc flash that might be encountered while performing work. In order to provide the desired level(s) of protection, these arc resistant clothing systems are typically made from relatively heavy fabrics, the prevailing theory and principle of operation being that heavy fabrics block the electromagnetic radiation and provide insulation from the radiant heating caused by the arc flash. However, suits made from such heavy fabrics often become uncomfortable when worn for prolonged periods of time owing, at least in part, to the low air permeability of the heavy fabrics.

Accordingly, there is a need for lighter weight flame-resistant fabrics that are flame-resistant and also protect from the radiation (e.g., near-infrared radiation) generated by an arc flash and are suitable for use in making garments that are comfortable to wear.

BRIEF SUMMARY OF THE INVENTION

In a first embodiment, the invention provides a flame-resistant fabric containing staple yarns which contain non-FR cellulosic fibers, modacrylic fibers, and non-flammable fibers intimately blended together. At least a portion of the non-flammable fibers comprise an energy absorbing additive to form energy absorbing fibers. The fabric comprises less than 14 wt. % of energy absorbing fibers and the fabric has an arc resistance according to ASTM F1959/F1959M-14e1 of at least 1.33 calories per square centimeter per ounce per square yard of fabric.

DETAILED DESCRIPTION OF THE INVENTION

The "Arc Thermal Protective Value" (ATPV) is a term used to refer to the minimum incident energy (expressed in calories per square centimeter) to which a fabric must be exposed in order to produce a fifty percent (50%) probability of causing the onset of a second-degree burn to skin underlying the fabric. The Arc Rating, which is the lower of the "Arc Thermal Protective Value (ATPV) and the "Breakopen Threshold Energy ($E_{BT}$) of a material (e.g., a flame-resistant fabric), can be determined in accordance with ASTM Standard Test Method F1959/F1959M-14e1 entitled "Standard Test Method for Determining the Arc Rating of Materials for Clothing." NFPA 70E sets the minimum arc rating required for various electrical hazards. In order to qualify as a category 2 garment, the garment must be made of fabric with a minimum arc rating of 8.0 cal/cm$^2$. Generally, fabrics that are lightweight (i.e., less than 6 ounces per square yard) are considered to be more comfortable to wear in most environments. Preferably, to satisfy the category 2 requirement of 8.0 cal/cm$^2$, and be 6.0 ounces per square yard or less, the arc resistance per weight ratio of a fabric must be at least 1.33 calories per square centimeter per ounce per square yard of fabric. More preferably, the flame-resistant fabric of the invention exhibits an arc resistance at least 1.4, at least about 1.5, at least about 1.60 calories per square centimeter per ounce per square yard of fabric. In other embodiments, the fabric may be of higher weight and have higher arc ratings for use in situations with a potential for higher energy arc flash events. In these embodiments, the ratio of arc rating to weight is still above 1.33 cal/cm$^2$ per ounce per square yard of fabric (i.e. when the arc rating is 12 cal/cm$^2$, the weight of the fabric will be less than about 9 ounces per square yard). More preferably, the flame-resistant fabric of the invention exhibits an arc resistance at least 1.4, at least about 1.5, at least about 1.6 calories per square centimeter per ounce per square yard of fabric.

As noted above, the invention provides arc-resistant fabrics that may be flame-resistant. As utilized herein, the term "flame-resistant" refers to a material that burns slowly or is self-extinguishing after removal of an external source of ignition. The flame resistance of flame-resistant fabrics can be measured by any suitable test method, such as those described in National Fire Protection Association (NFPA) 701 entitled "Standard Methods of Fire Tests for Flame Propagation of Textiles and Films," ASTM Standard Test Method D6413 entitled "Standard Test Method for Flame Resistance of Textiles (vertical test)", NFPA 2112 entitled "Standard on Flame-resistant Garments for Protection of Industrial Personnel Against Flash Fire", ASTM F1506-10a entitled "The Standard Performance Specification for Flame-resistant fabrics for Wearing Apparel for Use by Electrical Workers Exposed to Momentary Electric Arc and Related Thermal Hazards", and ASTM Standard Test Method F1930-11 entitled "Standard Test Method for Evaluation of Flame-resistant Clothing for Protection Against Flash Fire Simulations Using an Instrumented Manikin." It is preferred that the flame-resistant fabrics of the invention meet the minimum flame resistance requirements of NFPA 2112-18 including a maximum char length of 100 mm (4.0 inches) and a maximum of 2 seconds afterflame when tested according to ASTM Standard Test Method D6413. Preferably, the fabric has a thermal shrinkage less than 10% when tested in accordance with NFPA 2112-2012.

In one embodiment, the flame-resistant fabric has an arc rating of least about 8 calories/$cm^2$. In a preferred embodiment, the flame-resistant fabric an arc rating of least about 8.5 calories/$cm^2$, at least about 9 calories/$cm^2$, at least about 10 calories/$cm^2$, at least about 11 calories/$cm^2$, at least about 12 calories/$cm^2$.

The flame-resistant fabrics of the invention generally comprise a fabric (e.g., a textile or textile substrate) formed from a plurality of yarns. The fabric can be formed from a single plurality or type of yarn. The fabric can be of any suitable construction. In other words, the yarns forming the fabric can be provided in any suitable pattern wise arrangement producing the fabric. In one embodiment, the plurality of yarns forming the fabric comprise a plurality of first yarns disposed in a first direction in the fabric and a plurality of second yarns disposed in a second direction perpendicular to the first direction. Thus, the yarns forming the fabric preferably are provided in a woven pattern. Preferably, the yarns forming the fabric are provided in a woven pattern selected from the group consisting of basket weaves, sateen weaves, satin weaves, rip-stop weaves, and twill weaves. These woven patterns, most of which contain yarns that repeatedly float over two or more of the yarns running the perpendicular direction, produce a fabric having a greater thickness than a similar substrate formed from a plain weave. While not wishing to be bound to any particular theory, it is believed that this increased thickness may contribute, at least in part, to the enhanced protection from arc flashes (e.g., the near-infrared radiation produced by arc flashes) exhibited by the flame-resistant fabrics of the invention. In a preferred embodiment, the yarns forming the fabric are provided in a woven pattern selected from the group consisting of a 4×1 sateen weave, a 3×1 twill weave, and a 2×1 twill weave.

In another embodiment, the fabric is a knit fabric. The knit may be any suitable knit including a warp knit or circular knit. In one preferred embodiment, the circular knit is a jersey knit, Ponte de Roma knit, or a Swiss pique knit. These knits have been found to provide both good flame-resistance and comfort to a wearer.

In another embodiment, the fabric is a non-woven fabric. Non-woven fabrics are broadly defined as sheet or web structures bonded together by entangling fiber or filaments (and by perforating films) mechanically, thermally or chemically.

The arc-resistant and flame-resistant fabric comprises a plurality of fibers intimately blended together. These fibers at least contain non-flame-resistant (non-FR) cellulosic fibers, modacrylic fibers, and non-flammable fibers. The fabric can be formed solely from yarns comprising a one set blend of fibers or the fabric can be formed from two or more pluralities or different types of yarns (e.g., the fabric can be formed from a first plurality of yarns having a first blend and one or more other a second plurality of yarns comprising another fiber type or another blend of fibers).

The yarns forming the textile substrate can be any suitable type of yarn. Preferably, the fabric comprises staple fibers. Preferably, the staple fibers have an average length of between about 0.5 and 3 inches. In another embodiment, at least a portion of the yarns comprise both staple and continuous fibers. For example, at least some of the yarns, such as the warp yarns of a woven textile substrate, can be spun yarns. Preferably, the first yarns and the second yarns forming the textile substrate are both spun yarns. The spun yarns can be made from a single type of staple fiber, or the spun yarns can be made from a blend of two or more different types of staple fibers. Such spun yarns can be formed by any suitable spinning process, such as ring spinning, air-jet spinning, vortex spinning, or open-end spinning. Preferably, the yarns are spun using either a vortex spinning process or an air-jet spinning process. In such embodiments, both pluralities of yarns (i.e., the plurality of first yarns and the plurality of second yarns) can be spun using the same process, or each plurality of yarns can be spun using a different process. For example, one plurality of yarns can be spun using an open-end spinning process, and the other plurality of yarns can be spun using an air-jet spinning process. In one embodiment, spun yarns can be twisted together to form a 2-ply yarn. 2-ply yarns have been shown to improve strength and improve durability to laundering in woven fabrics.

The yarns forming the textile substrate can comprise any suitable fiber or any suitable blend of fibers. As noted above, the first yarns and the second yarns can be the same or different (i.e., the yarns can comprise the same fiber or blend of fibers or the yarns can comprise different fibers or blends of fibers).

Preferably, at least one plurality of yarns (e.g., the plurality of first yarns, the plurality of second yarns, or both) comprises non-flammable fibers. As utilized herein, the term "non-flammable fibers" is used to refer to synthetic fibers which, due to the chemical composition of the material from which they are made, exhibit flame resistance without the need for an additional flame-retardant treatment. These fibers are also referred to as inherent flame-resistant fibers. The non-flammable fibers can be any suitable non-flammable fibers, such as polyoxadiazole fibers, polysulfonamide fibers, poly(benzimidazole) fibers, poly(phenylenesulfide) fibers, aramid fibers (e.g., meta-aramid fibers and/or para-aramid fibers, and/or poly(amide-imide) fibers), polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, and combinations, mixtures, or blends thereof. When present in the yarns, the non-flammable fibers preferably are selected from the group consisting of polyoxadiazole fibers, polysulfonamide fibers, poly(benzimidazole) fibers, poly(phenylenesulfide) fibers, aramid fibers (e.g., meta-aramid fibers, and/or poly (amide-imide) fibers, and/or para-aramid fibers), and combinations, mixtures, or blends thereof.

Preferably, the non-flammable fibers are aramid fibers, such as meta-aramid fibers, poly amide-imide fibers, or para-aramide fibers, or a blend of fibers. In one preferred embodiment, the fibers are a blend of polyamide-imide fibers and para-aramid fibers.

When present in a yarn forming the textile substrate, the non-flammable fibers can comprise any suitable amount of the fibers present in the yarn. Preferably, the staple yarns comprise less than about 40% by weight non-flammable fibers, based on the total weight of the fibers present in the staple yarn. More preferably, the staple yarns comprise less than about 30% by weight non-flammable fibers, based on the total weight of the fibers present in the staple yarn. More preferably, the staple yarns comprise less than about 22% by weight non-flammable fibers, based on the total weight of the fibers present in the staple yarn. More preferably, the staple yarns comprise less than about 20% by weight non-flammable fibers, based on the total weight of the fibers present in the staple yarn. In another embodiment, the staple yarns comprise less than about 18% by weight non-flammable fibers, based on the total weight of the fibers present in the staple yarn.

In another embodiment, the fabric (as a whole) comprises less than about 40% by weight non-flammable fibers, based on the total weight of the fabric. Preferably, the fabric comprises less than about 30% by weight non-flammable fibers, based on the total weight of the fabric. Preferably, the fabric comprises less than about 22% by weight non-flammable fibers, based on the total weight of the fabric. Preferably, the fabric comprises less than about 18% by weight non-flammable fibers, based on the total weight of the fabric. More preferably, the fabric comprises less than about 15% by weight non-flammable fibers, based on the total weight of the fabric. In another embodiment, the fabric comprises less than about 10% by weight non-flammable fibers, based on the total weight of the fabric.

In one embodiment, the non-flammable fibers comprise a blend of more than one type of non-flammable fiber, preferably meta-aramid fibers or poly (amide-imide) fibers and para-aramid fibers. At least a portion of the non-flammable fibers comprise an energy absorbing additive. The energy absorbing fibers are typically dark in color (such as fibers loaded with carbon black). A lower amount of energy absorbing fibers in the fabric (while maintaining high flame and arc performance) is desirable as this allows the fabric to be a lighter color before dyeing. This in turn allows for lighter dyed fabrics to be produced such as grays, orange, royal blue, tans, and other medium to light shade colors which are more difficult to create when there is a much higher loading of dark colored energy absorbing fibers.

The term "energy-absorbing additive" is used herein to describe a material that absorbs electromagnetic radiation in near-infrared wavelengths (e.g., 700 nm to 2,000 nm or 700 nm to 1,400 nm). The energy-absorbing agent can absorb electromagnetic radiation in other portions of the electromagnetic spectrum (e.g., visible wavelengths). However, in order to provide protection against harm caused by infrared radiation generated by an arc flash, the energy-absorbing agent should exhibit an appreciable absorption of near-infrared radiation. This property of the energy-absorbing agent used in the flame-resistant fabric of the invention distinguishes it from a large portion of the energy-absorbing materials typically used to treat flame-resistant fabrics. In particular, a large portion of the energy-absorbing materials used to treat textiles (e.g., dyes and pigments) are designed or selected to exhibit an appreciable absorption of visible radiation, which imparts a perceptible color to the treated flame-resistant fabric. Because the absorption of infrared radiation has no effect on the visually-perceived color of the flame-resistant fabric, these typical energy-absorbing materials generally exhibit very little absorption of infrared radiation. Indeed, the absorbance of such materials at wavelengths of 800 nm can be less than ten percent of the maximum absorbance exhibited by the material in the visible wavelengths, with the absorbance at longer wavelengths (e.g., 1,000 nm) being even less. With such low absorption of infrared radiation and high absorption of visible radiation, these materials may be very darkly colored (i.e. black) but offer no benefit of increase arc rating.

Preferably, the energy absorbing additive is carbon black as that additive has been found to efficiently absorb energy and is cost effective. Carbon black has a nearly constant absorption through the visible and infrared portion of the electromagnetic spectrum. The amount of energy absorbing additive in the non-flammable fiber depends on the end use fabric properties, desired color, and processability. Preferably, the energy absorbing additives are located within the fibers (introduced during the manufacture of the fibers instead of being applied to the surface of the fibers after manufacture). This provides better wash durability and performance of the fabric after multiple washes. Preferably, the energy absorbing fibers (the non-flammable fibers that contain the energy absorbing additive) are meta-aramid fibers, more preferably poly(amide-imide) fibers.

Preferably, the staple yarns comprise less than about 20% by weight energy absorbing fibers, based on the total weight of the fibers present in the staple yarn. More preferably, the staple yarns comprise less than about 15% by weight energy absorbing fibers, based on the total weight of the fibers present in the staple yarn. More preferably, the staple yarns comprise less than about 14% by weight energy absorbing fibers, based on the total weight of the fibers present in the staple yarn. More preferably, the staple yarns comprise less than about 11% by weight energy absorbing fibers, based on the total weight of the fibers present in the staple yarn. Preferably, the fabric comprises less than about 20% by weight energy absorbing fibers, based on the total weight of the fabric. Preferably, the fabric comprises less than about 15% by weight energy absorbing fibers, based on the total weight of the fabric. Preferably, the fabric comprises less than about 14% by weight energy absorbing fibers, based on the total weight of the fabric. More preferably, the fabric comprises less than about 11% by weight energy absorbing fibers, based on the total weight of the fabric. Most preferably, the fabric comprises less than about 8% by weight energy absorbing fibers, based on the total weight of the fabric In one embodiment, the staple yarns comprise a blend of para-aramid fibers and poly(amide-imide) fibers as the non-flammable fibers with the poly (amide-imide) fibers being the energy absorbing fibers. In this embodiment, the para-aramid fibers are in an amount of less than about 10% by weight of the staple yarn. More preferably, the para-aramid fibers are in an amount of less than about 8% by weight of the staple yarn. More preferably, the para-aramid fibers are in an amount of less than about 5% by weight of the staple yarn. In this embodiment, the fabric (as a whole) preferably comprises less than about 10% by weight para-aramid fibers, based on the total weight of the fabric, more preferably less than 10%, more preferably less than 5%. In this embodiment, the energy absorbing fibers are in an amount of less than about 15% by weight of the staple yarn. Preferably, the energy absorbing fibers are in an amount of less than about 14% by weight of the staple yarn. Preferably, the energy absorbing fibers are in an amount of less than about 11% by weight of the staple yarn. Most preferably, energy absorbing fibers are in an amount of less than about 8% by weight of the staple yarn. In this embodiment, the fabric (as a whole) preferably comprises less than about 15% by weight energy absorbing fibers, based on the total weight of the fabric, more preferably less than 14%, more preferably less than 12%, more preferably less than about 8%.

The staple yarn forming the fabric preferably also include non-FR cellulosic fibers and modacrylic fibers. Preferably, the staple yarns comprising a greater amount by weight of non-FR cellulosic fibers than modacrylic fibers. As used herein, "non-FR cellulosic fiber" means any fiber consisting of or made from vegetable source(s) and not treated to be flame-resistant. As used herein, "non-FR synthetic cellulosic fiber" means any "non-FR cellulosic fiber" that is not naturally occurring but is manufactured from vegetable sources. Non-FR synthetic cellulosic fibers can include but are not limited to lyocell (a regenerated cellulose fiber made from dissolving bleached wood pulp, one brand of which is TENCEL™), rayon (a regenerated cellulose fiber, one brand of which is MODAL™), acetate, and the like. The non-FR cellulosic fiber can also be a naturally occurring fiber such as cotton, flax, hemp, or other cellulose vegetable fiber. Preferably, the staple yarns comprise between about 30 and 45% by weight of the yarns of non-FR cellulosic fibers. Preferably the non-FR cellulosic fibers are non-FR synthetic cellulosic fibers.

The staple yarns also include modacrylic fibers (e.g., PROTEX™ modacrylic fibers from Kaneka Corporation of Osaka, Japan). Modacrylic fibers are preferably added as they give the fabric flame resistance and are also dyable.

In one preferred embodiment, the staple yarns comprise between about 30 and 45 wt. % modacrylic fibers, about 35 and 55 wt. % non-FR cellulose fibers, and less than 20 wt. % non-flammable fibers intimately blended together, wherein between about 5 and 14 wt. % of the staple comprise an energy absorbing additive.

The staple yarns (or additional yarns in the fabric) may also comprise additional fibers including, but not limited to polyester fibers (e.g., poly(ethylene terephthalate) fibers, poly(propylene terephthalate) fibers, poly(trimethylene terephthalate) fibers), poly(butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, and combinations, mixtures, or blends thereof. The yarn(s) can include other synthetic fibers, such as static dissipative or antistatic fibers. For example, the yarns can also comprise natural fibers, such as cotton, linen, jute, hemp, or wool. The yarns can also comprise other fibers, such as rayon, lyocell, or acetate. When such fibers (e.g., cotton fibers) are present in the flame-resistant fabric of the invention, it may be desirable to treat the textile substrate or flame-resistant fabric with a flame retardant in order to impart some degree of flame resistance to these fibers and produce a flame-resistant fabric exhibiting a desired degree of flame resistance.

The textile substrate and the flame-resistant fabric of the invention can have any suitable weight (i.e., weight per unit area). The textile substrate preferably has a weight of about 16 oz/yd$^2$ or less (about 540 g/m$^2$ or less), about 14 oz/yd$^2$ or less (about 470 g/m$^2$ or less), about 12 oz/yd$^2$ or less (about 410 g/m$^2$ or less), about 10 oz/yd$^2$ or less (about 340 g/m$^2$ or less), about 9 oz/yd$^2$ or less (about 310 g/m$^2$ or less). More preferably, the textile substrate has a weight of about 8 oz/yd$^2$ or less (about 270 g/m$^2$ or less), more preferably about 7 oz/yd$^2$ or less (about 240 g/m$^2$ or less), more preferably about 6.5 oz/yd$^2$ or less (about 220 g/m$^2$ or less), more preferably about 6 oz/yd$^2$ or less (about 200 g/m$^2$ or less), more preferably about 5.75 oz/yd$^2$ or less (about 195 g/m$^2$ or less), and most preferably about 5.5 oz/yd$^2$ or less (about 190 g/m$^2$ or less). As was noted above, fabrics previously used in arc flash protection have generally been relatively heavy (i.e., they have had a relatively high weight per unit area). Therefore, the fact that the flame-resistant fabrics of the invention are capable of delivering the desired levels of arc flash protection at relatively light weights, such as weights of about 6 oz/yd$^2$ or less (about 200 g/m$^2$ or less), is surprising. Furthermore, these relatively light weight flame-resistant fabrics should be much more comfortable to wear for prolonged periods of time. In the embodiments where the fabric is a knit, the weight of the fabric may be higher due to the more open nature of the knit construction. For a knit fabric, the fabric preferably has a weight of less than about 9 oz/yd$^2$ or less (about 310 g/m$^2$ or less), more preferably, less than about 7 oz/yd$^2$ or less (about 230 g/m$^2$ or less).

The flame-resistant fabric of the invention can be used to make protective equipment designed to protect individuals from the hazards associated with an arc flash. For example, the flame-resistant fabric of the invention can be used as a component in single-layer or multiple-layer garments designed to exhibit a desired ATPV and/or exhibit a desired degree of flame resistance. For example, the flame-resistant fabric of the invention can be used to produce blankets and garments, such as shirts, pants, coveralls, coats, hoods, aprons, and gloves.

In addition to the flame-resistant fabric described above, the invention also provides a method for protecting an individual from infrared radiation (e.g., near-infrared radiation) that can be generated during an arc flash. The method comprises the step of positioning a flame-resistant fabric between an individual and an apparatus capable of producing an arc flash. The flame-resistant fabric used in the method is any embodiment of the flame-resistant fabric of the invention described above.

In this method embodiment of the invention, the flame-resistant fabric can be positioned at any suitable point between the individual and the apparatus. However, in order to ensure that the flame-resistant fabric is positioned to afford the greatest degree of protection to the individual, the flame-resistant fabric preferably forms part of a garment worn by the individual. Suitable garments include, but are not limited to, shirts, pants, coveralls, coats, hoods, aprons, and gloves. In a preferred embodiment, the outward-facing textile portions of a garment worn by the individual (i.e., those portions of the garment facing towards the apparatus when the garment is being worn by the individual) consist essentially of (or even more preferably consist of) a flame-resistant fabric according to the invention.

The following examples further illustrate the subject matter described above but, of course, should not be construed as in any way limiting the scope thereof.

EXAMPLES

These examples demonstrate the making of and properties of flame-resistant fabrics according to the invention and compares those properties to similar flame-resistant fabrics that have not been produced in accordance with the invention.

A series of fabrics were constructed by blending together fibers, creating a sliver, and utilizing vortex spinning to make a 2-ply spun yarns. In these examples, the warp and fill yarns are made from the same blend of fibers, although other embodiments are envisioned where the fiber blend of the warp yarns may be different from the fiber blend of the fill yarns. The fabrics were woven in a 2×1 left hand twill (LHT) construction and subsequently dyed and finished. The finished weight for each blend was approximately 5.5 oz/yd$^2$. The percentages of fibers in the blend of each example was varied (as shown in Table 1) to determine the effect of the blend percentage on the arc rating of the fabric.

TABLE 1

Blend percentages in example fabrics 1-7.

| | Example 1 | Example 2 | Example 3 | Example 4 | Example 5 | Example 6 | Example 7 |
|---|---|---|---|---|---|---|---|
| Poly (amide-imide) with carbon black. (Absorbing additive containing fiber) | 0% | 0% | 50% | 45% | 35% | 15% | 10% |
| Para-aramid (black - non absorbing color additive) | 0% | 12% | 0% | 5% | 5% | 5% | 5% |
| Para-aramid (natural/uncolored) | 12% | 0% | 0% | 0% | 0% | 0% | 0% |
| Lyocell | 48% | 48% | 27% | 33% | 33% | 44% | 47% |
| Modacrylic | 40% | 40% | 23% | 27% | 27% | 36% | 38% |

All of the example fabrics (examples 1 through 7) are flame resistant. In order words, they all have a char length of less than 4" when tested to ASTM D6413, and an after-flame time of less than 2 seconds. The arc resistance properties were tested according to F1959/F1959M-14e1. The ASTM F1959 test method provides for exposing fabric panels to various energy levels of electric arc flashes. Temperature sensors behind each panel record whether the energy transmitted through the fabric to the sensor would be sufficient to cause a second-degree burn. A nominal logistic regression of the data from multiple panel tests (typically 21-24 panels) at various energies is used to determine the arc energy that results in a 50% likelihood of a second degree burn. This value is termed the "Arc Thermal Protective Value" (ATPV). In addition, each panel is inspected after each arc flash and a determination is made whether the fabric has a hole or tear. This data is used in a similar manner to determine the arc energy level that results in a 50% likelihood of a breakopen of the fabric. This value is termed the "Breakopen Threshold Energy" ($E_{BT}$). The arc rating is the lower of the two values. In some cases, the ATPV is lower than the $E_{BT}$, and in other cases the $E_{BT}$ is lower than the ATPV.

The ATPV or $E_{BT}$ values for examples 1 through 7 are listed below in Table 2. Since each fabric has an areal weight of 5.5 oz/yd$^2$, the Arc rating/weight ratio is simply the arc rating divided by 5.5 (as also shown in Table 2). Considering examples 1 and 2, the only difference between these two examples is that example 1 utilized 12% natural (uncolored) para-aramid, and example 2 utilized 12% black (producer-dyed) para-aramid. Example 1 and Example 2 have the same arc rating (ATPV) because despite being dark colored, the black producer-dyed para-aramid fiber utilized in example 2 is not energy absorbing in the infrared region of the electromagnetic spectrum. These example fabrics (examples 1 and 2), despite being flame resistant, do not have the required 8 cal/cm$^2$ arc rating necessary for Category 2 tasks as outlined in NFPA 70E and ASTM F1506.

TABLE 2

Arc Rating of Examples 1 through 7 when tested according to ASTM F1959

| | Example 1 | Example 2 | Example 3 | Example 4 | Example 5 | Example 6 | Example 7 |
|---|---|---|---|---|---|---|---|
| ATPV (cal/cm2) | 6.6 | 6.6 | — | — | — | 11 | 9.1 |
| EBT (cal/cm2) | — | — | 7.2 | 10 | 9.8 | — | — |
| Arc rating/weight (cal/cm$^2$/oz/yd$^2$) | 1.20 | 1.20 | 1.31 | 1.82 | 1.78 | 2.00 | 1.65 |

In example 3, the blend contains 50% of a poly(amide-imide) fiber with an energy absorbing additive (carbon black). This fabric has an $E_{BT}$ of 7.2 cal/cm$^2$. Without being bound be any particular theory, it is believed that during the arc flash test, the energy absorbing additive absorbs the radiant energy from the arc flash and converts it to heat energy. This heat energy causes stresses in the fabric panel resulting in a breakopen. The arc rating is improved over examples 1 and 2, but still fails to reach the desired level of 8 cal/cm$^2$.

Examples 4 and 5 incorporate 5% para-aramid into the blend along with the poly(amide-imide) with the energy absorbing additive. The inclusion of the para-aramid strengthens the fabric and delays the breakopen to higher energies. These fabrics have achieved the desired level of arc resistance per weight of fabric, however, the inclusion of 35%-45% of fibers containing carbon black makes the fabric color very dark, thus limiting the color space available.

Examples 6 and 7 have blends that incorporate only 15% and 10% of poly(amide-imide) fibers with energy absorbing additives, respectively. The arc ratings are well above the desired value of 8.0 cal/cm$^2$, and the $E_{BT}$ is now higher than the ATPV. While not being bound to any particular theory, it is believed that the lower amount of energy absorbing additive containing fiber results in a lower amount of heat produced by energy absorption. However, the level of energy absorption is sufficient to prevent transmission of radiant energy to provide a high ATPV value.

This level of arc rating to weight ratio (greater than 1.33) is surprising with such a low level of energy absorbing additive containing fiber. In prior art examples of US 201 801 71 51 6 (Stanhope et al., which is incorporated herein by reference), much higher levels of fibers with energy absorbing additives were required to reach arc rating to weight ratios of greater than 1.33. In this reference, examples are provided at 16%, 25%, 30%, and 50% composition of fibers with energy absorbing additives. In only the case of 50% composition of fibers with energy absorbing additive is the arc rating to weight ratio greater than 1.33. In each of these examples, the fabrics are made from a fiber blend consisting of additive containing meta-aramid, modacrylic, and lyocell. However, in contrast to the inventive fabrics disclosed in this application, there are no para-aramid fibers included in the blends disclosed in this reference. In addition, the fiber blend composition of this prior art reference consists of a higher percentage of modacrylic than lyocell. This is also in contrast to the present invention in which the amount of lyocell in the blend is greater than or equal to the level of modacrylic fiber.

Without being bound by any particular theory, the unexpected performance of the present invention, in which the arc rating to weight ratio is 1.65 with the inclusion of only 10% of additive containing fibers, can be explained with two theories.

First, the inclusion of para-aramid fibers appears to have provided strength to the fabric and increased the energy at which breakopen will occur. This level of para-aramid is low enough to avoid many of the drawbacks of para-aramids, such as the lack of dyeability and the tendency for fibrillation during laundering, but high enough to provide strength to the fabric during arc flash events.

Secondly, the higher amount of lyocell may be responsible for the higher ATPV values by a char formation process. In fabrics that contain fibers with energy-absorbing additives, the radiant energy from the arc flash is absorbed by the energy-absorbing additives in the fibers, thereby preventing transmission of the energy to the wearer of the garment. However, this energy will be re-emitted back to wearer (or sensor in an arc flash test) which may cause burns at a subsequent time, (i.e. a few seconds after the initial arc flash). When lyocell, or other cellulosic fibers are exposed to high heat, they degrade and form a char layer on their surface. This process of char formation can absorb heat energy that may otherwise be re-emitted. The high level of lyocell in the inventive fabric (greater than or equal to the level of modacrylic fibers in the blend) creates a reservoir for heat absorption in the fabric and may prevent the re-emission of the thermal energy that was absorbed by the fibers with energy absorbing additives.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A flame-resistant fabric comprising staple yarns, wherein the staple yarns comprise an intimate blend of:

non-FR cellulosic fibers, wherein the staple yarns comprise between about 35 and 55 wt. % non-FR cellulose fibers;

modacrylic fibers, wherein the staple yarns comprise between about 30 and 45 wt. % modacrylic fibers and wherein the staple yarns comprising a greater amount by weight of non-FR cellulosic fibers than modacrylic fibers;

para-aramid fibers, wherein the staple yarns comprise less than 10 wt. % para-aramid fibers; and, non-flammable polyamide-imide fibers, wherein the non-flammable polyamide-imide fibers comprise an energy absorbing additive to form energy absorbing fibers, and wherein the flame-resistant fabric has an arc resistance according to ASTM F1959/F1959M-14e1 of at least 1.33 calories per square centimeter per ounce per square yard of fabric and wherein the flame-resistant fabric comprises less than 11 wt. % of energy absorbing fibers based on the total weight of the flame-resistant fabric.

2. The flame-resistant fabric of claim 1, wherein the non-FR cellulosic fibers comprise non-FR synthetic cellulosic fibers.

3. The flame-resistant fabric of claim 1, wherein the energy absorbing additive is carbon black.

4. The flame-resistant fabric of claim 1, wherein the fabric has an arc rating to fabric weight ratio of at least about 1.5.

5. The flame-resistant fabric of claim 1, wherein the fabric has an arc rating of least about 10 calories/cm$^2$.

6. The flame-resistant fabric of claim 1, wherein the fabric has a weight of less than about 5.75 ounces per square yard.

7. The flame-resistant fabric of claim 1, wherein the fabric is a woven or knit fabric.

8. The flame-resistant fabric of claim 7, wherein the fabric has a weight of less than about 7.0 ounces per square yard.

9. The flame-resistant fabric of claim 1, wherein the fabric has an average char length less than 4 inches when tested in accordance with ASTM D6413.

10. The flame-resistant fabric of claim 1, wherein the fabric has a thermal shrinkage less than 10% when tested in accordance with NFPA 2112-2012.

11. A garment constructed from the flame-resistant fabric of claim 1.

* * * * *